US008122676B2

(12) United States Patent
Lemyre

(10) Patent No.: US 8,122,676 B2
(45) Date of Patent: Feb. 28, 2012

(54) TOP-CHORD BEARING WOODEN JOIST

(75) Inventor: André Lemyre, Trois-Rivières (CA)

(73) Assignee: Solive Ajouree 2000 Inc., Trois-Rivieres, Quebec (CA)

( * ) Notice: Subject to any disclaimer, the term of this patent is extended or adjusted under 35 U.S.C. 154(b) by 350 days.

(21) Appl. No.: 12/424,937

(22) Filed: Apr. 16, 2009

(65) Prior Publication Data

US 2010/0263319 A1 Oct. 21, 2010

(51) Int. Cl.
*E04C 3/18* (2006.01)
*E04C 3/12* (2006.01)
*E04C 3/292* (2006.01)

(52) U.S. Cl. ..... 52/696; 52/690; 52/693; 52/838

(58) Field of Classification Search ..... 52/289, 52/690, 693, 695, 696, 702, 837, 838
See application file for complete search history.

(56) References Cited

U.S. PATENT DOCUMENTS

| | | | | |
|---|---|---|---|---|
| 1,565,879 | A * | 12/1925 | White | 52/693 |
| 1,704,235 | A * | 3/1929 | Zabriskie | 52/693 |
| 3,345,792 | A * | 10/1967 | Chandler | 52/650.3 |
| 3,490,188 | A * | 1/1970 | Troutner | 52/644 |
| 3,531,904 | A * | 10/1970 | Sanford | 52/696 |
| 3,651,612 | A * | 3/1972 | Schmitt | 52/693 |
| 4,001,999 | A * | 1/1977 | Chandler | 52/693 |
| 4,031,686 | A * | 6/1977 | Sanford | 52/693 |
| 4,143,500 | A * | 3/1979 | Sanford | 52/693 |
| 4,336,678 | A * | 6/1982 | Peters | 52/837 |
| 4,349,996 | A | 9/1982 | Lautensleger et al. | |

(Continued)

FOREIGN PATENT DOCUMENTS

GB 2 039 582 A * 8/1980

(Continued)

OTHER PUBLICATIONS

International Search Report, PCT/CA2010/000290, May 20, 2010.

*Primary Examiner* — Robert Canfield
(74) *Attorney, Agent, or Firm* — Norton Rose Canada LLP

(57) ABSTRACT

A wooden joist is described. The joist comprises a wooden top chord, a wooden bottom chord, and a main section comprising at least one of wooden boards and wooden webs adhesively connected to the wooden top chord and to the wooden bottom chord to form at least one of an I-joist subsection and an open-joist subsection along the main section of the wooden joist. An end configuration at one end of the main section comprises a wooden post extending generally perpendicularly between the wooden top chord and the wooden bottom chord and is adjacent to the main section. A wooden diagonal web extends diagonally from the wooden top chord to the wooden bottom chord. A first set of metal plates is in alignment on opposed sides of the wooden joist to connect the wooden top chord to the diagonal web. A second set of metal plates is in alignment on opposed sides of the wooden joist to connect the diagonal web and the post to the bottom chord. A third set of metal plates is in alignment on opposed sides of the wooden joist to connect the wooden top chord to the post. An extension is defined by the wooden top chord extending beyond the diagonal web at an end of the wooden joist. The wooden joist is adapted to be in a top-chord bearing relation with a beam by the extension being on top of the beam.

16 Claims, 7 Drawing Sheets

U.S. PATENT DOCUMENTS

| | | | | | |
|---|---|---|---|---|---|
| 4,630,424 | A | * | 12/1986 | Eberle et al. | 52/693 |
| 4,641,480 | A | * | 2/1987 | Mort | 52/693 |
| 4,669,243 | A | | 6/1987 | Gore et al. | |
| 4,677,806 | A | * | 7/1987 | Tuomi | 52/656.1 |
| 4,862,662 | A | * | 9/1989 | Eberle et al. | 52/299 |
| 4,982,545 | A | | 1/1991 | Stromback | |
| 5,592,800 | A | | 1/1997 | Koo et al. | |
| 5,867,963 | A | | 2/1999 | Hershey | |
| 6,018,921 | A | * | 2/2000 | Lindsay | 52/690 |
| 6,212,846 | B1 | * | 4/2001 | Johnston | 52/648.1 |
| 6,584,741 | B1 | * | 7/2003 | Hatzinikolas | 52/289 |
| 6,715,257 | B2 | * | 4/2004 | Kent et al. | 52/837 |
| 7,240,463 | B2 | | 7/2007 | Masterson et al. | |
| 7,509,781 | B2 | * | 3/2009 | Veilleux et al. | 52/692 |
| 7,730,692 | B1 | * | 6/2010 | Hershey | 52/634 |
| 2010/0205892 | A1 | * | 8/2010 | Lemyre | 52/693 |

FOREIGN PATENT DOCUMENTS

WO 2010/118531 A1 * 10/2010

* cited by examiner

TOP-CHORD BEARING WOODEN JOIST

FIELD OF THE APPLICATION

The present application relates to wooden joists and, more particularly, to a wooden joist used in a top-chord bearing configuration.

BACKGROUND OF THE ART

Wooden joists are horizontal supporting members that run from wall to wall, wall to beam, or beam to beam to support a ceiling, roof or floor. Wooden joists have a pair of horizontal chords, interrelated by a board in an I-joist configuration, or by V-shaped webs, in an open-joist or joist configuration.

When wooden joists are transversely connected to beams, metal hangers are used to interrelate the joists to the beams. Hangers are brackets that are secured to the beam, and that define a U-shaped so as to support an end of a joist. Hangers are costly items, and require a non-negligible amount of skilled manpower to use.

Some wooden joists are used in a top-chord bearing configuration. In this configuration, the top chord has an extension projecting beyond the bottom chord at an end of the joist. The extension is seated on top of a beam, when the joist is transversely positioned on a beam. As all-wooden joists typically use an adhesive between the chords and the wooden webs/board, all-wooden joists are not used in a top-chord bearing configuration. The top-chord bearing configuration is used with open joists in which the webs are metal, or in open joists in which metal square plates interface the wooden webs to the chords. Both these open joists are relatively expensive as they use numerous metal components.

SUMMARY OF THE APPLICATION

It is therefore an aim of the present application to provide a novel wooden joist for use in a top-chord bearing configuration.

It is a further aim of the present application to a method for adapting a wooden joist to a top-chord bearing configuration.

Therefore, in accordance with the present application, there is provided a wooden joist comprising: a wooden top chord; a wooden bottom chord; a main section comprising at least one of wooden boards and wooden webs adhesively connected to the wooden top chord and to the wooden bottom chord to form at least one of an I-joist subsection and an open-joist subsection along the main section of the wooden joist; an end configuration at least one end of the main section, comprising: a wooden post extending generally perpendicularly between the wooden top chord and the wooden bottom chord and being adjacent to the main section; a wooden diagonal web extending diagonally from the wooden top chord to the wooden bottom chord; a first set of metal plates in alignment on opposed sides of the wooden joist to connect the wooden top chord to the diagonal web; a second set of metal plates in alignment on opposed sides of the wooden joist to connect the diagonal web and the post to the bottom chord; a third set of metal plates in alignment on opposed sides of the wooden joist to connect the wooden top chord to the post; and an extension defined by the wooden top chord extending beyond the diagonal web at an end of the wooden joist; whereby the wooden joist is adapted to be in a top-chord bearing relation with a beam by the extension being on top of the beam.

Further in accordance with the present application, there is provided a wooden joist comprising: a wooden top chord; a wooden bottom chord; a main section comprising at least one of wooden boards and wooden webs adhesively connected to the wooden top chord and to the wooden bottom chord to form at least one of an I-joist subsection and an open-joist subsection along the main section of the wooden joist; an end configuration at least one end of the main section, comprising: a first wooden post extending generally perpendicularly between the wooden top chord and the wooden bottom chord and being adjacent to the main section; a wooden diagonal web extending diagonally from the wooden top chord to the wooden bottom chord; a wooden second post extending generally perpendicularly from the wooden top chord to the wooden bottom chord at an end of the bottom chord; a first set of metal plates in alignment on opposed sides of the wooden joist to connect the wooden top chord to the diagonal web and to the first post; a second set of metal plates in alignment on opposed sides of the wooden joist to connect the diagonal web and the second post to the bottom chord; a third set of metal plates in alignment on opposed sides of the wooden joist to connect the wooden top chord to the second post; a fourth set of metal plates in alignment on opposed sides of the wooden joist to connect the wooden bottom chord to the first post; and an extension defined by the wooden top chord extending beyond the second post at an end of the wooden joist; whereby the wooden joist is adapted to be in a top-chord bearing relation with a beam by the extension being on top of the beam.

Still further in accordance with the present application, there is provided a wooden joist comprising: a wooden top chord; a wooden bottom chord; a main, section comprising at least wooden boards adhesively connected to the wooden top chord and to the wooden bottom chord to form at least an I-joist subsection along the main section of the wooden joist; an end configuration at least one end of the main section, comprising: a wooden post extending generally perpendicularly between the wooden top chord and the wooden bottom chord and being adjacent to the I-joist subsection of the main section; a first set of metal places in alignment on opposed sides of the wooden joist to connect the wooden top chord to the wooden post; a second set of metal plates in alignment on opposed sides of the wooden joist to connect the post to the bottom chord; and an extension defined by the wooden top chord extending beyond the post at an end of the wooden joist; whereby the wooden joist is adapted to be in a top-chord bearing relation with a beam by the extension being on top of the beam.

DESCRIPTION OF THE PREFERRED EMBODIMENTS

Figure 1:
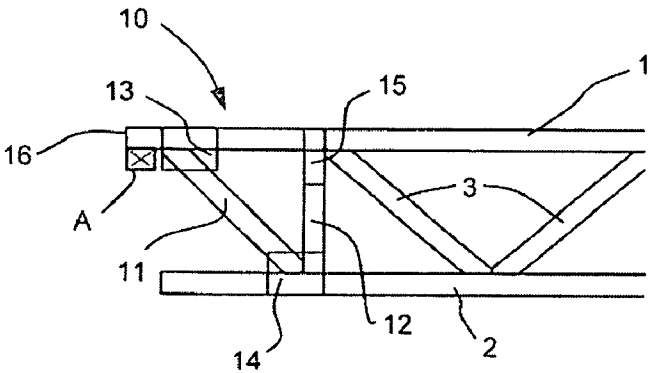
FIG. 1 is a schematic view of a joist-end configuration in accordance with a first embodiment of the present disclosure, the first joist-end configuration being adjacent to an open-joist section of a joist.
Figure 2:
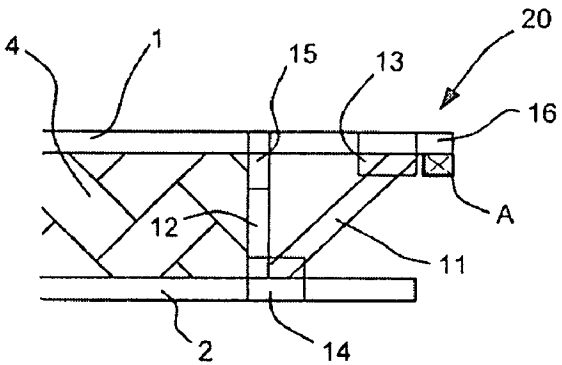
FIG. 2 is a schematic view of the joist-end configuration of FIG. 1, as adjacent to an I-joist section of a joist.

Referring to the drawings, and more particularly to FIGS. 1 to 19, joist-end configurations are illustrated at the ends of joists comprising a top chord 1, a bottom chord 2, and a main section of joist comprising at least one of an open-joist subsection of wooden webs 3 (FIG. 1), and an I-joist subsection of wooden boards 4 (FIG. 2). Reference numerals 1 to 4 are used hereinafter to refer to these components. The joists of FIGS. 1-19 are said to be all-wooden, in that the top chord 1, the bottom chord 2, the open-joist subsection of wooden webs 3 and the I-joist subsection of wooden boards 4 are interconnected by an adhesive, and complementary joints (e.g., finger joints).

Referring to FIG. 1, a first joist-end configuration is illustrated at 10, at the end of an open-joist section of a joist. The first joist-end configuration 10 has a diagonal 11 (a.k.a., an end web) and a post 12 (i.e., column) between the top chord 1 and the bottom chord 2. The diagonal 11 is connected to the top chord 1 by a first set 13 of metal plates (one shown, but with one on each side of the top chord 1). The diagonal 11 and the post 12 intersect at the bottom chord 2, with a second set 14 of metal plates (one shown) connecting the bottom chord 2, the diagonal 11 and a bottom end of the post 12. The diagonal 11 has a double-cut end so as to have a first surface in planar contact with the bottom chord 12, and a second surface in planar contact with the post 12. A top end of the post 12 is connected to the top chord 1 by a third set 15 of metal plates. For clarity of the illustrations, the sets of metal plates are shown as being transparent throughout FIGS. 1 to 10.

The metal plates of the sets 13, 14 and 15 and all other sets described hereinafter are of the type having serrated surfaces that will grip into the wooden components when pressed against them. The metal plates (which may be a plurality of sub-plates) are paired up such that metal plates are in alignment on opposed sides of the chords 1 and 2. Moreover, the sets 13, 14 and 15 may have any suitable dimension. Accordingly, the various wooden components of the joist-end configurations described above and hereinafter, such as the diagonal 11 and the post 12, have the same width as the top chord 1 and the bottom chord 2, for the metal plates to form a planar joint when connecting such pieces. It is not required to use adhesives to connect the wooden components with the top chord 1 and the bottom chord 2, when metal plates are used.

In the embodiment of FIG. 1, the diagonal 11 is connected to the top chord 1 adjacent to an end thereof, thereby defining an extension 16 (i.e., a bearing extension). The extension 16 is the interface of the top chord 1 with beam A when the joist is in a top-chord bearing relation with the beam A, as illustrated in FIG. 1. Accordingly, by the diagonal 11 being adjacent to the extension 16, the joist-end configuration 10 has the diagonal 11 in tension.

Referring to FIG. 2, a joist-end configuration is shown at 20, and is similar to the joist-end configuration 10 of FIG. 1, whereby like elements will bear like reference numerals. A difference between the joist-end configurations 10 and 20 is that the joist-end configuration 20 is adjacent to an I-joist section of the joist, as opposed to an open-joist section for the joist-end configuration 10. The joist-end configuration 20 therefore also has the diagonal 11 in tension.

Figure 3:
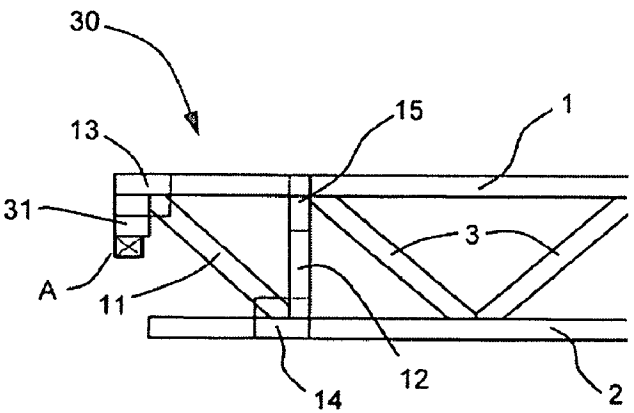
FIG. 3 is a schematic view of the joist-end configuration of FIG. 1, with a support block.

Referring to FIG. 3, a joist-end configuration is shown at 30, and is similar to the joist-end configuration 10 of FIG. 1, whereby like elements will bear like reference numerals. A difference between the joist-end configurations 10 and 30 is that the joist-end configuration 30 has a support block 31. The support block 31 is connected to the top chord 1 by the first set 13 of metal plates, and interfaces the top chord 1 to the beam A when the joist is in the top-chord bearing relation with the beam A. The joist-end configuration 30 advantageously has the set 13 of metal plates above the bearing interface between the beam A and the support block 31. This configuration increases the capacity of the joist.

Figure 4:
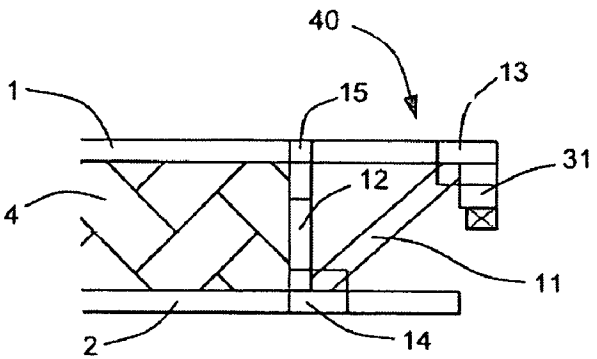
FIG. 4 is a schematic view of the joist-end configuration of FIG. 3, as adjacent to an I-joist section of a joist.

Referring to FIG. 4, a joist-end configuration is shown at 40, and is similar to the joist-end configuration 30 of FIG. 3, whereby like elements will bear like reference numerals. A difference between the joist-end configurations 30 and 40 is that the joist-end configuration 40 is adjacent to an I-joist section of the joist, as opposed to an open-joist section for the joist-end configuration 30.

Figure 5:
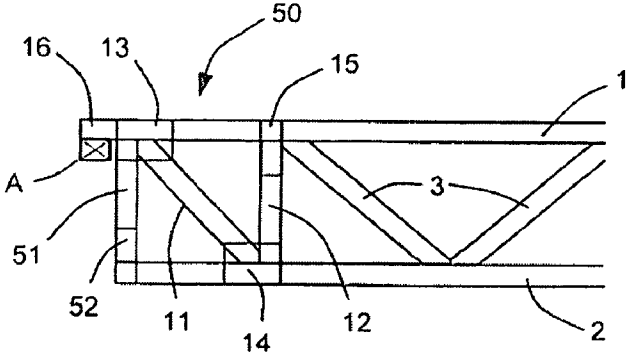
FIG. 5 is a schematic view of the joist-end configuration of FIG. 3, with a secondary post.

Referring to FIG. 5, a joist-end configuration is shown at 50, and is similar to the joist-end configuration 10 of FIG. 1, whereby like elements will bear like reference numerals. A difference between the joist-end configurations 10 and 50 is that the joist-end configuration 50 has a second post 51. The second post 51 is connected to the top chord 1 at an intersection with the diagonal 11, whereby the top chord 1, the diagonal 11 and the second post 51 are interconnected by the first set 13 of metal plates. The second post 51 is connected to the bottom chord 2 by a fourth set 52 of metal plates. Accordingly, the second post 51 has the same width as the top chord 1, the bottom chord 2, the diagonal 11 and the post 12. Because of the second post 51, the first set 13 of metal plates have a greater gripping surface with wooden components of the joist, thereby increasing the capacity of the joist.

Figure 6:
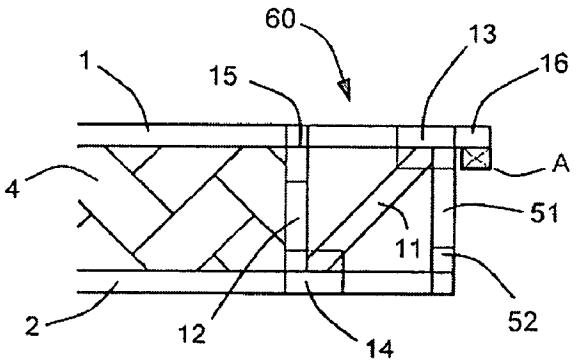
FIG. 6 is a schematic view of the joist-end configuration of FIG. 1, as adjacent to an I-joist section of a joist.

Referring to FIG. 6, a joist-end configuration is shown at 60, and is similar to the joist-end configuration 50 of FIG. 5, whereby like elements will bear like reference numerals. A difference between the joist-end configurations 50 and 60 is that the joist-end configuration 60 is adjacent to an I-joist section of the joist, as opposed to an open-joist section for the joist-end configuration 50.

Figure 7:
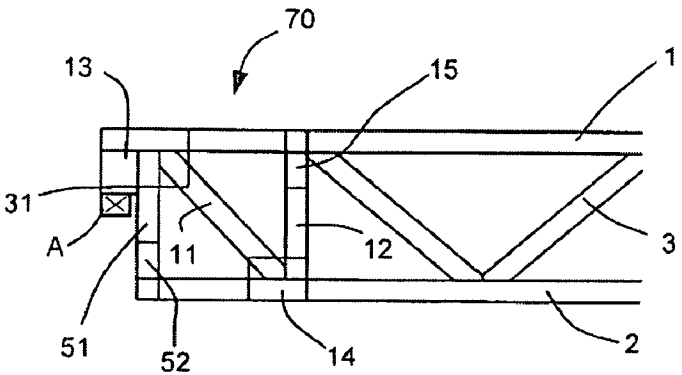
FIG. 7 is a schematic view of the joist-end configuration of FIG. 5, with a support block.

Referring to FIG. 7, a joist-end configuration is shown at 70 is similar to the joint-end configurations 30 (FIG. 3) and 50

(FIG. 5), whereby like elements will bear like reference numerals. Essentially, the joist-end configuration 70 has the support block 31 and the second post 51, as well as the appropriate sets of metal plates to interconnect these wooden components to a remainder of the joist. The joist-end configuration 70 therefore benefits in terms of capacity from the presence of the support block 31 and of the second post 51.

Figure 8:
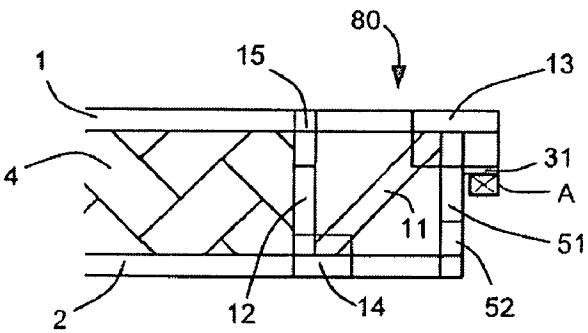
FIG. 8 is a schematic view of the joist-end configuration of FIG. 7, as adjacent to an I-joist section of a joist.

Referring to FIG. 8, a joist-end configuration is shown at 80, and is similar to the joist-end configuration 70 of FIG. 7, whereby like elements will bear like reference numerals. A difference between the joist-end configurations 70 and 80 is that the joist-end configuration 80 is adjacent to an I-joist section of the joist, as opposed to an open-joist section for the joist-end configuration 70.

Figure 9:
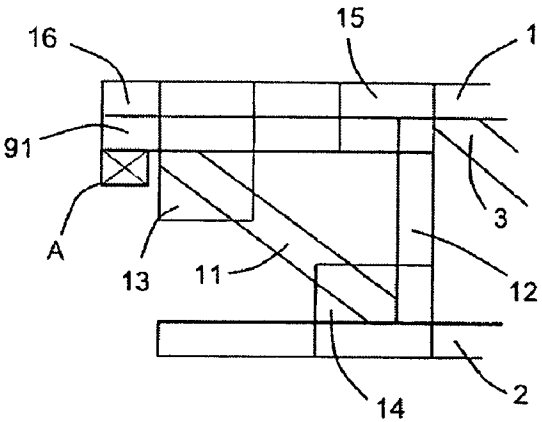
FIG. 9 is a schematic view of the first joist-end configuration of FIG. 1, with a secondary top chord.

Referring to FIG. 9, a joist-end configuration is shown at 90, and is similar to the joist-end configuration 10 of FIG. 1, whereby like elements will bear like reference numerals. The joist-end configuration 90 has a secondary top chord 91. The secondary top chord 91 is connected against an undersurface of the top chord 1, from extends along the joist from the post 12 to the extension 16. The sets 13 of metal plates connect the top chord 1, the diagonal 11 and the secondary top chord 91. The sets 15 of metal plates connect the top chord 1, the top end of the post 12 and the secondary top chord 91. The secondary top chord 91 lies on the beam A when the joist is in top-chord bearing relation with the beam A. The addition of the secondary top chord 91 increases the capacity of the joist.

Figure 10:
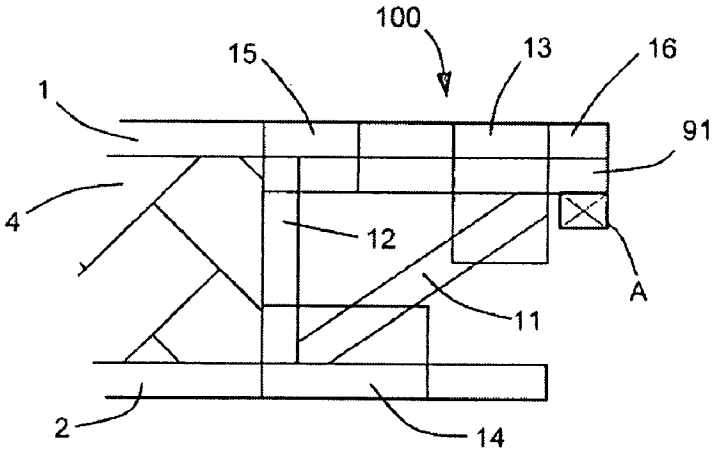
FIG. 10 is a schematic view of the joist-end configuration of FIG. 9, as adjacent to an I-joist section of a joist.

Referring to FIG. 10, a joist-end configuration is shown at 100, and is similar to the joist-end configuration 90 of FIG. 9, whereby like elements will bear like reference numerals. A difference between the joist-end configurations and 100 is that the joist-end configuration 100 is adjacent to an I-joist section of the joist, as opposed to an open-joist section for the joist-end configuration 90.

Figure 11:
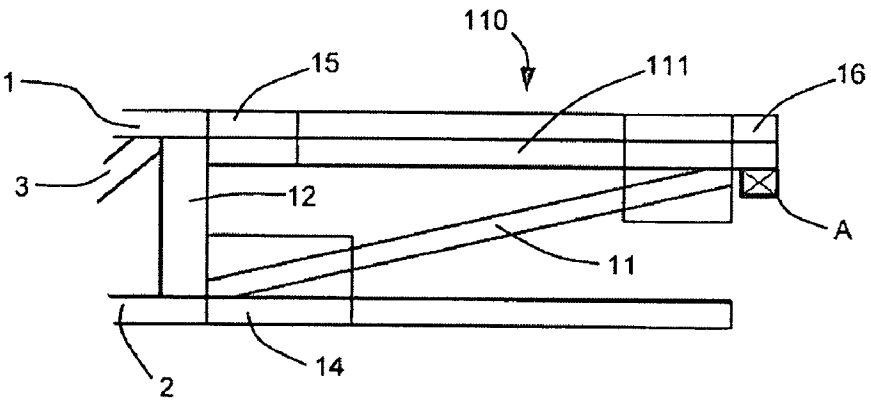
FIG. 11 is a schematic view of the joist-end configuration of FIG. 9, with a longer secondary top chord.

Referring to FIG. 11, a joist-end configuration is shown at 110, and is similar to the joist-end configuration 90 of FIG. 9, whereby like elements will bear like reference numerals. However, in the joist-end configuration 110, the portion of the top chord 1 extending from the post 12 to the extension 16 is longer than that of the joist-end configuration 90 of FIG. 1. Accordingly, the diagonal 11 and secondary top chord 111 are longer than the joist-end configurations of FIGS. 1 to 10. It is observed that the sets 14 and 15 of metal plates do not connect the post 12 to the top chord 1 and to the bottom chord 2, as chords 1 and 2 are wider than the post 12. Although not illustrated, the joist-end configuration 110 may be used adjacent to I-joist sections.

In FIGS. 1 to 12, the diagonal 11 connects to the top chord 1 adjacent to the beam A, and connects to the bottom chord 2 adjacent to the post 12.

Figure 12:
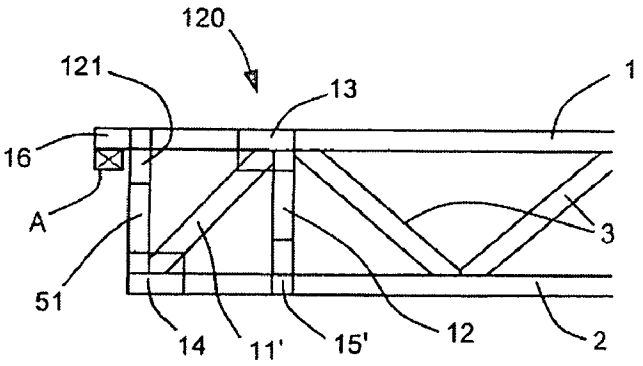
FIG. 12 is a schematic view of a joist-end configuration in accordance with another embodiment of the present disclosure, the joist-end configuration being adjacent to an open-joist section of a joist.

Referring to FIGS. 12 to 15, alternatives embodiments are shown, in which the diagonal is oriented differently than in FIGS. 1 to 11, and is therefore in compression. Referring to FIG. 12, a joist-end configuration 120 is similar to the joist-end configuration 10 of FIG. 1, whereby like elements will bear like reference numerals. In the joist-end configuration 120, diagonal 11' connects to the too chord 1 adjacent to the post 12, by the set 13 of metal plates interconnecting the three components. The secondary post 51 is connected to the bottom chord 2 by the set 14 of metal plates, and is connected to the top chord 1 by a fourth set 121 of metal plates. The post 12 is connected to the bottom chord 2 by set 15' of metal plates. Because of the orientation of the diagonal 11', the joist-end configuration 120 has smaller metal plates than for a different orientation of diagonal, thereby representing lesser costs.

Figure 13:
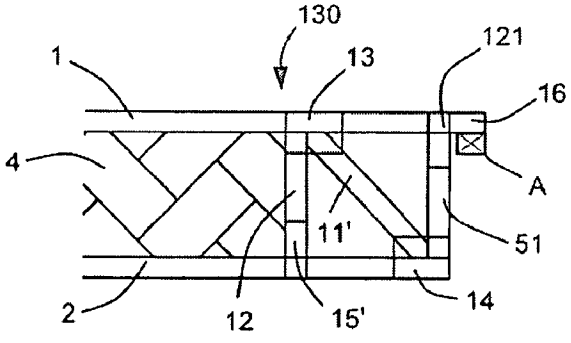
FIG. 13 is a schematic view of the joist-end configuration of FIG. 12, as adjacent to an I-joist section of a joist.

Referring to FIG. 13, a joist-end configuration is shown at 130, and is similar to the joist-end configuration 120 of FIG. 12, whereby like elements will bear like reference numerals. A difference between the joist-end configurations 120 and 130 is that the joist-end configuration 130 is adjacent to an I-joist section of the joist, as opposed to an open-joist section for the joist-end configuration 120.

Figure 14:
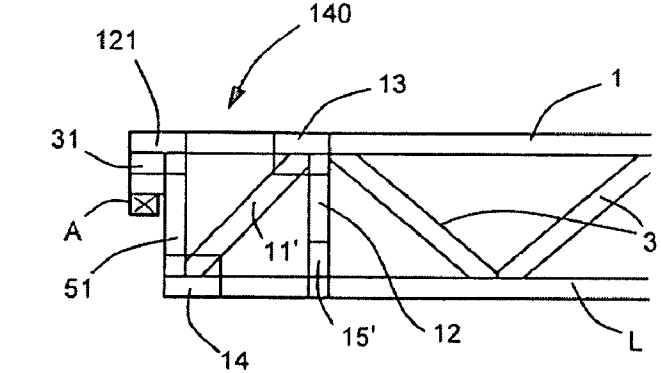
FIG. 14 is a schematic view of the joist-end configuration of FIG. 12, with a support block.

Referring to FIG. 14, a joist-end configuration 140 is similar to the joist-end configuration 120 of FIG. 12, whereby like elements will bear like reference numerals. A difference between the joist-end configurations 120 and 140 is the use of the support block 31 has interface between the beam A and the top chord 1. The joist-end configuration 140 advantageously has the fourth set 121 of metal plates above the bearing interface between the beam A and the support block 31. This configuration increases the capacity of the joist.

Figure 15:
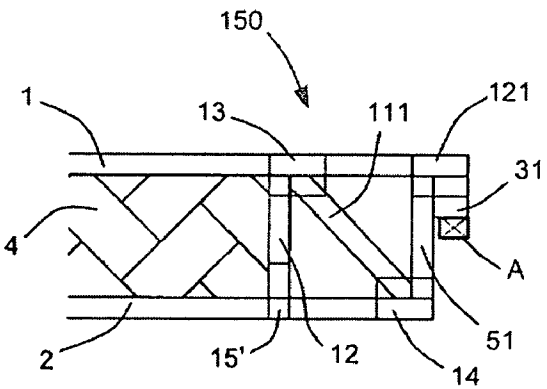
FIG. 15 is a schematic view of the joist-end configuration of FIG. 14, as adjacent to an I-joist section of a joist.

Referring to FIG. 15, a joist-end configuration is shown at 150, and is similar to the joist-end configuration 140 of FIG. 14, whereby like elements will bear like reference numerals. A difference between the joist-end configurations 140 and 150 is that the joist-end configuration 150 is adjacent to an I-joist section of the joist, as opposed to an open-joist section for the joist-end configuration 140.

It is pointed out that the bottom chord 2, the diagonals 11/11' the vertical posts 12 and the second posts 51 may all have a secondary twin member, as the top chord 1 does with the secondary top chord 91 (in FIG. 9). Secondary twin members would increase the capacity of the joist.

Figure 16:
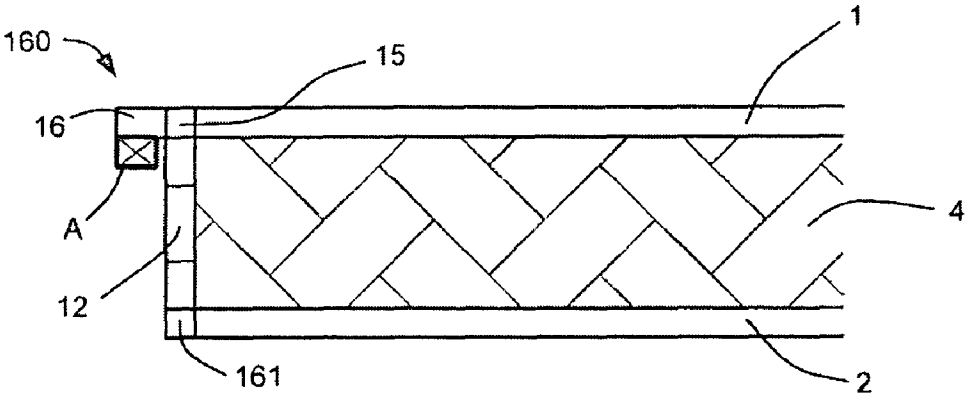
FIG. 16 is a schematic view of a joist-end configuration in accordance with yet another embodiment of the present disclosure, the joist-end configuration being adjacent to an I-joist section of a joist.

Referring to FIG. 16, another joist-end configuration is illustrated at 160, with reference to reference numerals used previously for similar elements of the other joist-end configurations. In the joist-end configuration 160, there is no diagonal, but rather a single vertical post 12 connected to the bottom chord 2 by a set 161 of metal plates.

Now that a plurality of the joist-end configurations are described, different types of joists using such configurations are shown. Although the addition of elements increase the structural integrity of the joists, some applications are exposed to lesser loads in which simple configurations such as the joist-end configuration 10 of FIG. 1 or the joist-end configuration 160 of FIG. 16 are suitable and cost-efficient.

Figure 17:
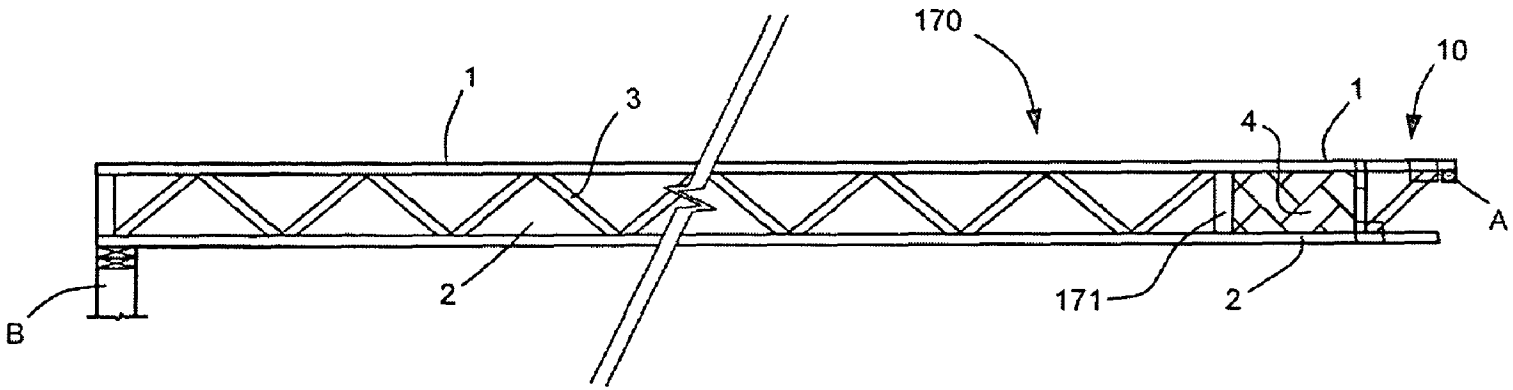
FIG. 17 is a longitudinal view of a joist with the joist-end configuration of FIG. 2 at one end.

In FIG. 17, a joist 170 has the joist-end configuration 10 (amongst all other possibilities) in top-chord bearing relation with the beam A, whereas another end is in a bottom-chord bearing relation with beam B. Adjustments to the length of the joist 170 are made by removing a given length of the wooden panels 4 of the I-joist subsection, to then add the various elements of the configuration 10. This is typically done off-site.

Figure 18:
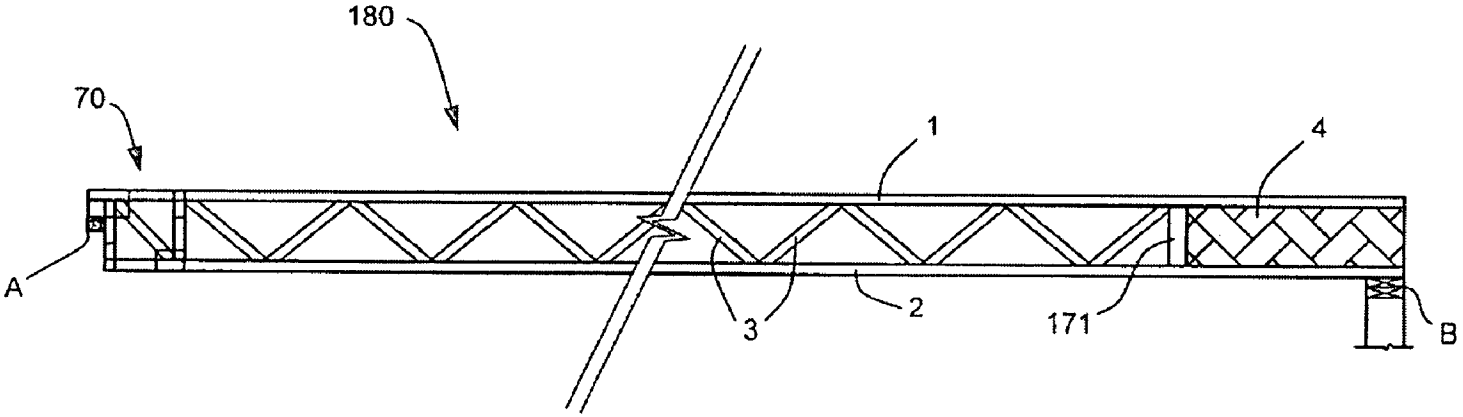
FIG. 18 is a longitudinal view of a joist with the joist-end configuration of FIG. 7 at one end.

Referring to FIG. 18, the joist 180 has the joist-end configuration 70 (amongst all other possibilities) in top-chord bearing relation with beam A. As the joist-end configuration 70 is adjacent to an open-joist subsection, a longitudinal adjustment of the joist 180 may be done on-site by removing an exceeding length of the I-joist subsection.

Figure 19:
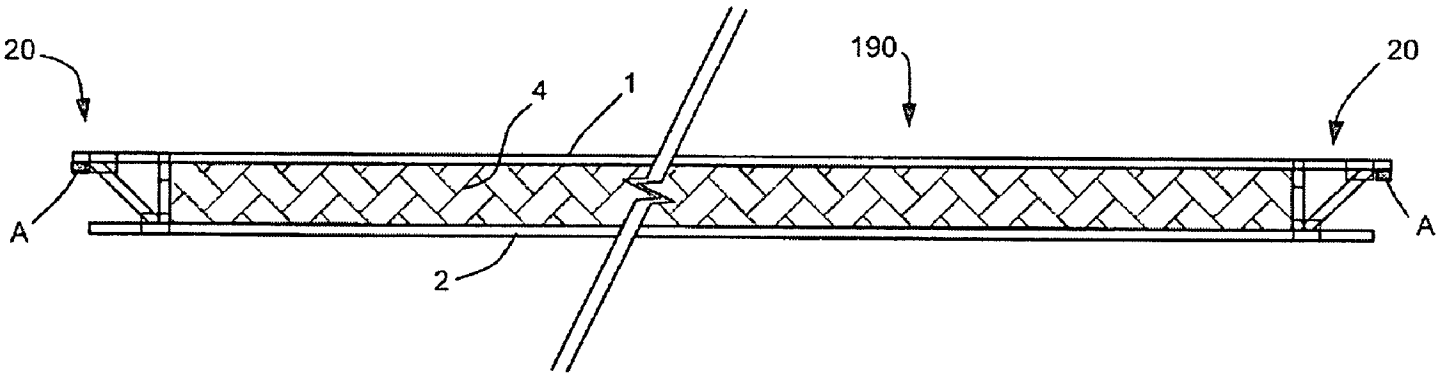
FIG. 19 is a longitudinal view of an I-joist section with the joist-end configurations of FIG. 2 at both ends.

It is pointed out that the joists and joist-end configurations described for FIGS. 1-16 may be used at both ends of a joist, for the joist to be in top-chord bearing relation at both ends. As an example thereof, FIG. 19 illustrates a joist 190 having a set of the joist-end configurations 20 supported by beams A. Any other suitable combination of joist-end configurations is considered.

Figure 20:
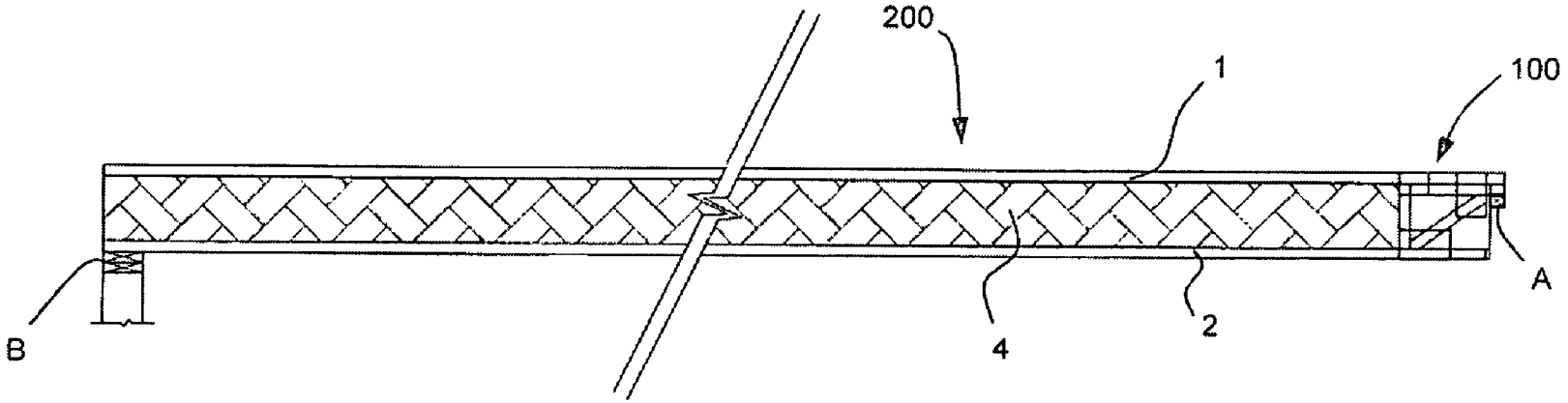
FIG. 20 is a longitudinal view of an I-joist section with the joist-end configuration of FIG. 10 at one end.

Referring to FIG. 20, joist 200 has the joist-end configuration 100 in top-chord bearing relation with beam A. The joist 200 is an I-joist that is in a bottom-chord bearing relation with beam B at the other end. Accordingly, a portion of the I-joist section may be removed prior to installation, for the joist 200 to have a selected length. Although not illustrated, it is pointed out that both ends of the joist 200 may each have the joist-end configuration 100.

The invention claimed is:

1. A wooden joist comprising:

a wooden top chord;

a wooden bottom chord;

a main section comprising at least one of wooden boards and wooden webs adhesively connected to the wooden top chord and to the wooden bottom chord to form at least one of an I-joist subsection and an open-joist subsection along the main section of the wooden joist;

an end configuration at least one end of the main section, comprising:

a wooden post extending generally perpendicularly between the wooden top chord and the wooden bottom chord and being adjacent to the main section;

a wooden diagonal web in direct contact with and extending diagonally from the wooden top chord to the wooden bottom chord;

a first set of metal plates in alignment on opposed sides of the wooden joist to connect the wooden top chord to the diagonal web;

a second set of metal plates in alignment on opposed sides of the wooden joist to connect the diagonal web and the post to the bottom chord;

a third set of metal plates in alignment on opposed sides of the wooden joist to connect the wooden top chord to the post; and an extension defined by the wooden top chord extending beyond a junction of the diagonal web and the top chord at an end of the wooden joist;

whereby the wooden joist is adapted to be in a top-chord bearing relation with a beam by the extension being on top of the beam.

2. The wooden joist according to claim 1, further comprising a block positioned on an undersurface of the extension, with the first set of metal plates connecting the wooden top chord, the diagonal web and the block, whereby the wooden joist is adapted to be in a top-chord bearing relation with the beam by the block being between the extension and the beam.

3. The wooden joist according to claim 1, further comprising a second post extending generally perpendicularly between the wooden top chord and the wooden bottom chord at an end of the bottom chord, with the first set of metal plates connecting the wooden top chord, the diagonal web and the second post.

4. The wooden joist according to claim 3, further comprising a block positioned on an undersurface of the extension, with the first set of metal plates connecting the wooden top chord, the diagonal web, the second post and the block, whereby the wooden joist is adapted to be in a top-chord bearing relation with the beam by the block being between the extension and the beam.

5. The wooden joist according to claim 1, further comprising a second wooden top chord positioned against an undersurface of the top chord, and extending from the post to an end of the extension, with the first set of metal plates connecting the wooden top chord, the second top chord and the diagonal web, and the third set of metal plates connecting the wooden top chord, the second top chord and the post.

6. The wooden joist according to claim 1, wherein the main section has an I-joist subsection at an end of the wooden joist opposite from the end configuration, the I-joist subsection having a portion thereof removed, such that the wooden joist has a selected length.

7. The wooden joist according to claim 1, wherein the main section has an I-joist subsection adjacent to the end configuration, the I-joist subsection having a portion of wooden boards removed prior to the end configuration being installed in the wooden joist, such that the wooden joist has a selected length.

8. The wooden joist according to claim 1, wherein at least one of the wooden post and the wooden diagonal web has a twin member in side-by-side relation along the joist.

9. The wooden joist according to claim 1, further comprising one of the end configuration at each end of the main section, whereby the wooden joist is in top-chord bearing relations with beams at each end.

10. A wooden joist comprising:

a wooden top chord;

a wooden bottom chord;

a main section comprising at least one of wooden boards and wooden webs adhesively connected to the wooden top chord and to the wooden bottom chord to form at least one of an I-joist subsection and an open-joist subsection along the main section of the wooden joist;

an end configuration at least one end of the main section, comprising:

a first wooden post extending generally perpendicularly between the wooden top chord and the wooden bottom chord and being adjacent to the main section;

a second wooden post extending generally perpendicularly from the wooden top chord to the wooden bottom chord at an end of the bottom chord;

a wooden diagonal web extending diagonally from the wooden top chord to the wooden bottom chord and being located between the first wooden post and the second wooden post;

a first set of metal plates in alignment on opposed sides of the wooden joist to connect the wooden top chord to the diagonal web and to the first post;

a second set of metal plates in alignment on opposed sides of the wooden joist to connect the diagonal web and the second post to the bottom chord;

a third set of metal plates in alignment on opposed sides of the wooden joist to connect the wooden top chord to the second post;

a fourth set of metal plates in alignment on opposed sides of the wooden joist to connect the wooden bottom chord to the first post; and an extension defined by the wooden top chord extending beyond the second post at an end of the wooden joist;

whereby the wooden joist is adapted to be in a top-chord bearing relation with a beam by the extension being on top of the beam.

11. The wooden joist according to claim 10, further comprising a block positioned on an undersurface of the extension, with the third set of metal plates connecting the wooden top chord, the second post and the block, whereby the wooden joist is adapted to be in a top-chord bearing relation with the beam by the block being between the extension and the beam.

12. The wooden joist according to claim 10, further comprising a second wooden top chord positioned against an undersurface of the top chord, and extending from the first post to an end of the extension, with the first set of metal plates connecting the wooden top chord, the second top chord, the diagonal web, and the first post, and the third set of metal plates connecting the wooden top chord, the second top chord and the second post.

13. The wooden joist according to claim 10, wherein the main section has an I-joist subsection at an end of the wooden joist opposite from the end configuration, the I-joist subsection having a portion thereof removed, such that the wooden joist has a selected length.

14. The wooden joist according to claim 10, wherein the main section has an I-joist subsection adjacent to the end configuration, the I-joist subsection having a portion of wooden boards removed prior to the end configuration being installed in the wooden joist, such that the wooden joist has a selected length.

15. The wooden joist according to claim 10, wherein at least one of the first post, the second post and the diagonal web has a twin member in side-by-side relation along the joist.

16. The wooden joist according to claim 10, further comprising one of the end configuration at each end of the main section, whereby the wooden joist is in top-chord bearing relations with beams at each end.

* * * * *